US010240886B1

(12) United States Patent
Huang

(10) Patent No.: US 10,240,886 B1
(45) Date of Patent: Mar. 26, 2019

(54) ADJUSTABLE STABILIZER SYSTEM

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 5 days.

(21) Appl. No.: 15/849,868

(22) Filed: Dec. 21, 2017

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/89
See application file for complete search history.

(56) References Cited

U.S. PATENT DOCUMENTS 3,589,350 A * 6/1971 Hoyt, Jr. ..... F41B 5/1426 124/89
4,054,121 A * 10/1977 Hoyt, Jr. ..... F41B 5/1426 124/88
5,390,656 A * 2/1995 Villa ..... F41B 5/1426 124/89
5,531,211 A * 7/1996 Wilfong, Jr. ..... F41B 5/14 124/25.6
5,630,407 A * 5/1997 Gasser ..... F41B 5/1426 124/89
5,992,403 A * 11/1999 Slates ..... F41B 5/1426 124/89
6,205,992 B1 * 3/2001 Meeks ..... F41B 5/14 124/86
7,753,044 B2 * 7/2010 Goade ..... F41B 5/1426 124/86
8,225,778 B2 * 7/2012 Walk ..... F41B 5/066 124/89
8,347,870 B1 * 1/2013 Mahutga ..... F41B 5/1426 124/89
8,833,356 B2 * 9/2014 Khoshnood ..... F41B 5/1426 124/86
8,893,700 B2 * 11/2014 Kozlik ..... F41B 5/1426 124/23.1
9,032,947 B2 * 5/2015 Bidigare ..... F41B 5/1426 124/89
9,038,617 B1 * 5/2015 Khoshnood ..... F41B 5/1426 124/89
9,347,732 B2 * 5/2016 Bidigare ..... F41B 5/1426
9,377,269 B2 * 6/2016 Bidigare ..... F41B 5/1426
9,377,270 B2 * 6/2016 Stokes ..... F41B 5/1426
9,759,510 B1 * 9/2017 Kempf ..... F41B 5/1426
9,803,950 B1 * 10/2017 Khoshnood ..... F41B 5/1453
(Continued)

*Primary Examiner* — Alexander R Niconovich
(74) *Attorney, Agent, or Firm* — Donald J. Ersler

(57) ABSTRACT

An adjustable stabilizer system preferably includes a bow mount member, a bow mount member with quick release, an elbow link member, an elbow link member with a quick release, a tightening elbow, a single thread coupler, a double threaded coupler and a weight with an o-ring. The bow mount member preferably includes a bow mounting base and a bow pivoting extension. The pivoting extension extends outward from one end of the mounting base. A threaded tap is formed in an opposing end of the mounting base. The elbow link member preferably includes an elbow mounting base and an elbow pivoting extension. The elbow pivoting extension extends outward from one end of the elbow mounting base and a threaded tap is formed in an opposing end of the elbow mounting base. The elements of the adjustable stabilizer system may be assembled in any suitable configuration.

9 Claims, 5 Drawing Sheets

(56) References Cited

U.S. PATENT DOCUMENTS

| | | | | |
|---|---|---|---|---|
| 2006/0283435 | A1* | 12/2006 | Pellerite | F41B 5/1426 124/89 |
| 2007/0151553 | A1* | 7/2007 | Leven | F41B 5/1426 124/89 |
| 2010/0192931 | A1* | 8/2010 | Brewster | F41B 5/1407 124/89 |
| 2011/0120440 | A1* | 5/2011 | Stokes | F41B 5/1426 124/89 |
| 2011/0259313 | A1* | 10/2011 | Reinhold | F41B 5/1426 124/89 |
| 2012/0125309 | A1* | 5/2012 | Khoshnood | F41B 5/1426 124/89 |
| 2014/0060514 | A1* | 3/2014 | Bidigare | F41B 5/1426 124/88 |
| 2015/0184973 | A1* | 7/2015 | Martens | F41B 5/1426 124/23.1 |
| 2015/0316343 | A1* | 11/2015 | Simonds | F41B 5/1426 124/89 |
| 2018/0031347 | A1* | 2/2018 | Omre | |

* cited by examiner

ADJUSTABLE STABILIZER SYSTEM

BACKGROUND OF THE INVENTION

1. Field of the Invention

The present invention relates generally to archery and more specifically to an adjustable stabilizer system, which enables a stabilizer to be adjusted in any plane and at any angle.

2. Discussion of the Prior Art

It appears that the prior art does not disclose an adjustable stabilizer system, which allows a stabilizer to be adjusted in any plane and at any angle.

Accordingly, there is a clearly felt need in the art for an adjustable stabilizer system, which enables a stabilizer to be adjusted in any plane and at any angle.

SUMMARY OF THE INVENTION

The present invention provides an adjustable stabilizer system, which enables a stabilizer to be adjusted in any plane and at any angle. The adjustable stabilizer system preferably includes a bow mount member and an elbow link member. The bow mount member preferably includes a bow mounting base and a bow pivoting extension. The pivoting extension extends outward from one end of the bow mounting base. A threaded tap is formed in an opposing end of the mounting base. A counterbore is formed one side of the pivoting extension, substantially perpendicular to the opposing end of the mounting base. A bottom of the counterbore is preferably flush with a centerline of the threaded tap. A bow mount member with quick release includes the bow mount base and a quick release cavity. The quick release cavity is formed in one end of the bow mount member and the threaded tap is formed in an opposing end thereof. The quick release cavity is sized to receive a quick release pin. A U-shaped slot is formed through an end of the bow mount base to the quick release cavity. The quick release pin includes a substantially rectangular body and a threaded retention tap formed therethrough.

The elbow link member preferably includes an elbow mounting base and an elbow pivoting extension. The elbow pivoting extension extends outward from one end of the elbow mounting base and a threaded tap is formed in an opposing end of the elbow mounting base. A first surface of the elbow pivoting extension is flush with a centerline of the threaded tap. An o-ring is preferably formed in the first surface. A fastener clearance hole is formed through the elbow pivoting extension. A tightening elbow includes an elbow body. The threaded tap is formed in one end of the elbow body. A pivot slot is formed in an opposing end of the elbow body and perpendicular to the one end of the elbow body. A bottom of the pivot slot is flush with a center line of the threaded tap. The threaded tap is formed at a bottom of the pivot slot.

An elbow link with quick includes the elbow mounting base and a quick release cavity. The quick release cavity is formed in one end of the elbow link with quick release and the threaded tap is formed in an opposing end thereof. A single thread coupler includes a threaded tap formed through a length thereof. A double thread coupler includes a first threaded tap in a first end and a second threaded tap formed in a second end thereof. A weight with an o-ring includes an o-ring. An o-ring groove is formed one side of the weight to receive the o-ring.

Accordingly, it is an object of the present invention to provide an adjustable stabilizer system, which enables a stabilizer to be adjusted in any plane and at any angle.

These and additional objects, advantages, features and benefits of the present invention will become apparent from the following specification.

DETAILED DESCRIPTION OF THE PREFERRED EMBODIMENTS

Figure 1:
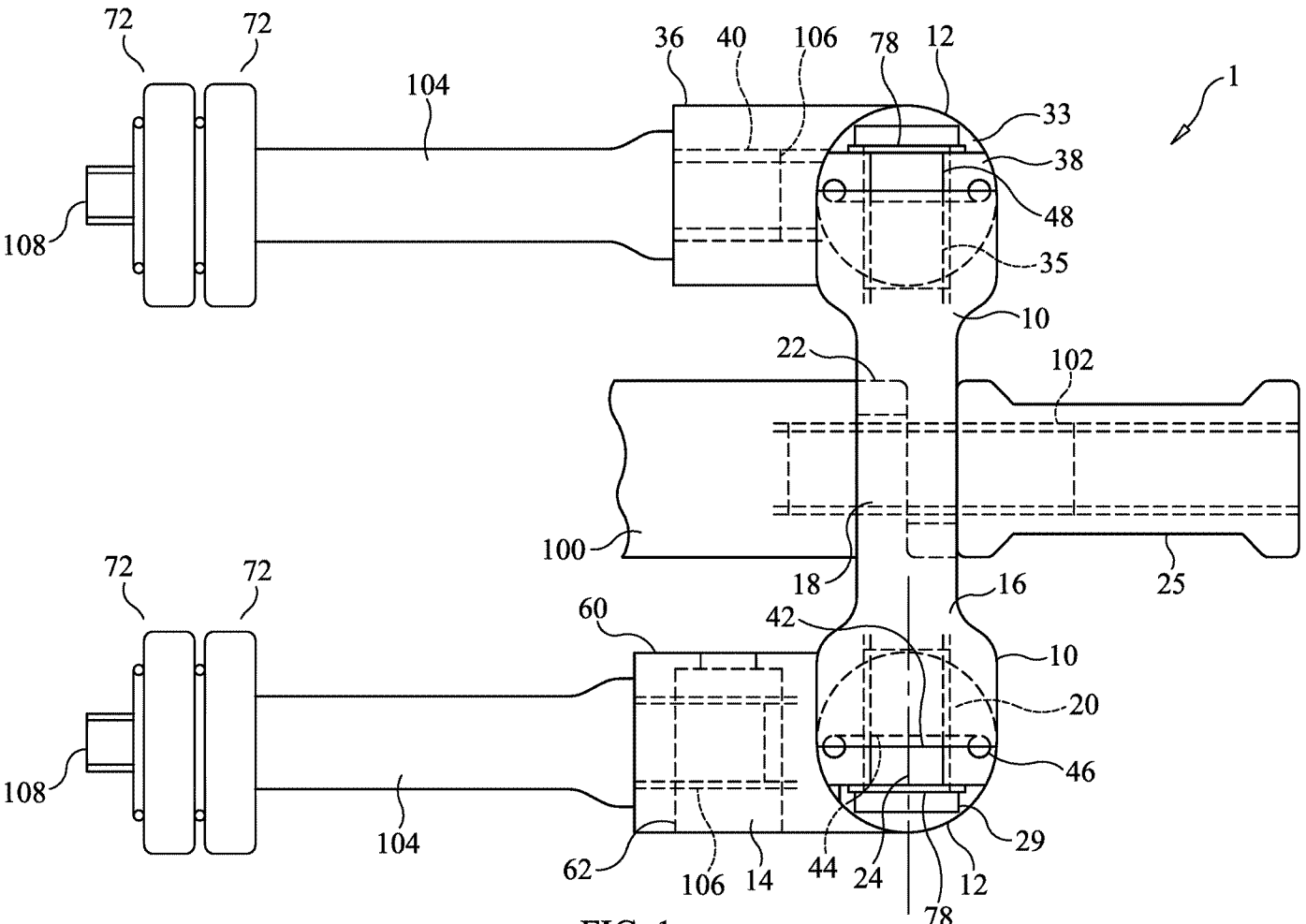
FIG. 1 is a top view of an adjustable stabilizer system including a coupler, two bow mount members, three elbow link members, an elbow link member with quick release, two stabilizers and four weights with o-rings in accordance with the present invention.
Figure 2:
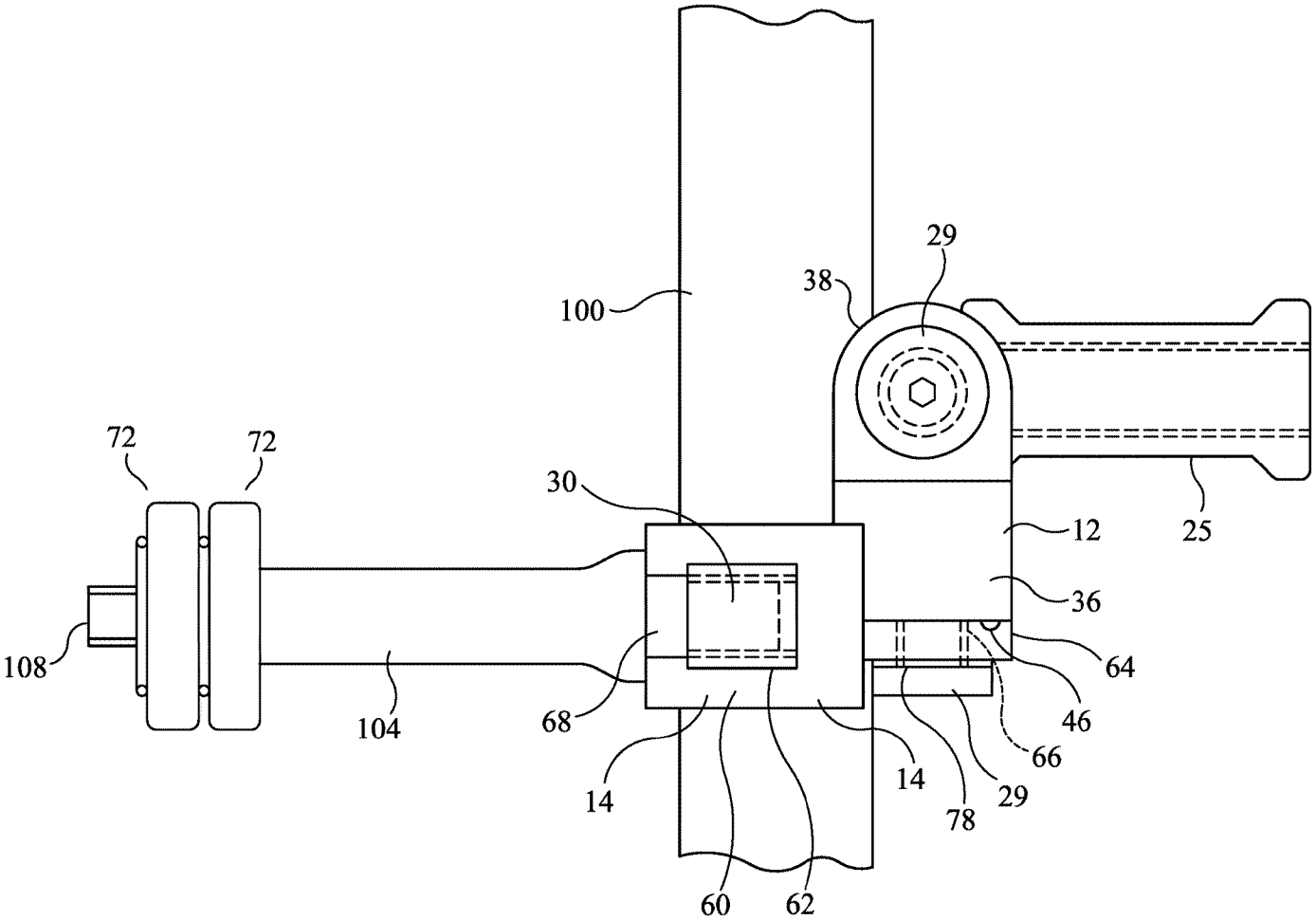
FIG. 2 is a side view of an adjustable stabilizer system including a coupler, two bow mount members, three elbow link members, an elbow link member with quick release, two stabilizers and four weights with o-rings in accordance with the present invention.
Figure 3:
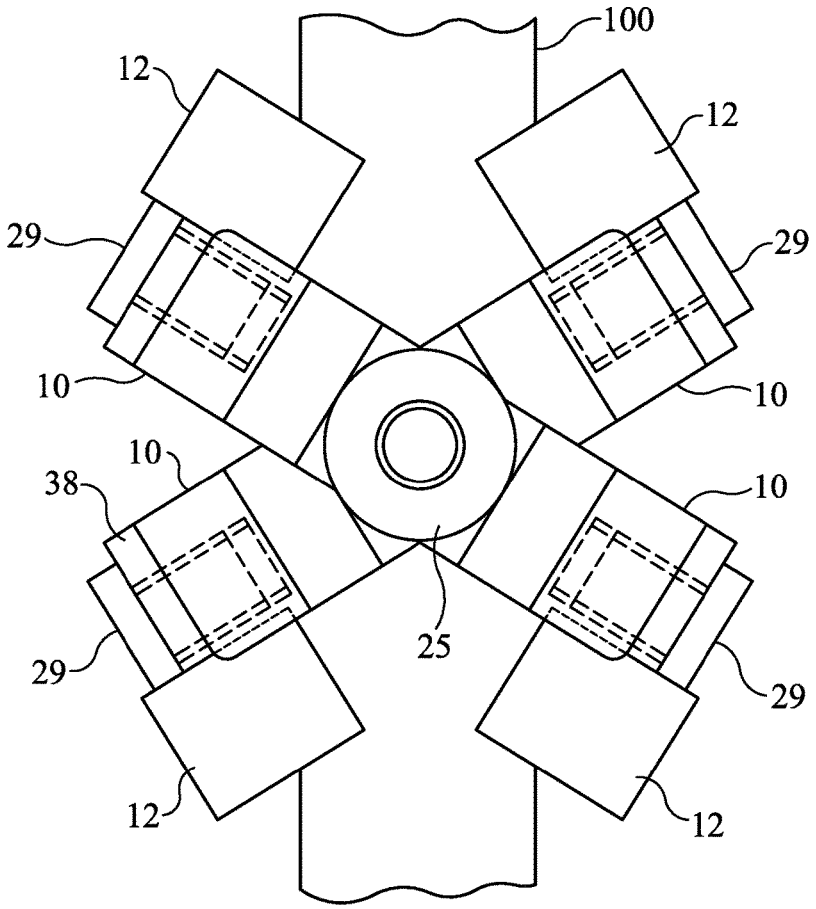
FIG. 3 is a front view of an adjustable stabilizer system including a coupler, four bow mount members, four elbow link members and four weights with o-rings in accordance with the present invention.
Figure 9:
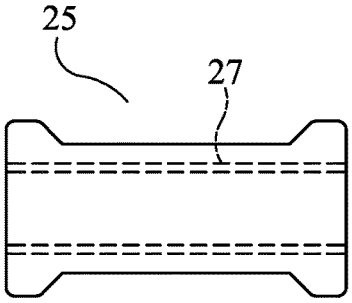
FIG. 9 is a side view of a coupler with one tap size of an adjustable stabilizer system in accordance with the present invention.
Figure 13:
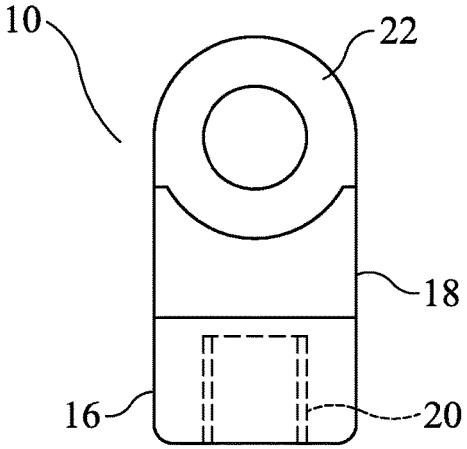
FIG. 13 is a side view of a bow mount member of an adjustable stabilizer system in accordance with the present invention.

With reference now to the drawings, and particularly to FIG. 1, there is shown a top view of an adjustable stabilizer system 1. With reference to FIGS. 2-3, the adjustable stabilizer system 1 preferably includes two bow mount members 10, three elbow link members 12 and an elbow link member with quick release 14. With reference to FIG. 13, the bow mount member 10 preferably includes a bow mounting base 16 and a bow pivoting extension 18. The pivoting extension 18 extends outward from one end of the mounting base 16. A threaded tap 20 is formed in an opposing end of the mounting base 16. A counterbore 22 is formed on one side of the pivoting extension 18, substantially perpendicular to the opposing end of the mounting base 10. A bottom of the counterbore 22 is preferably flush with a centerline 24 of the threaded tap 20. With reference to FIG. 9, the two side mount members 10 are mounted to a riser 100 of a vertical bow with a threaded stud 102 and a coupler 25 or the like. The threaded stud 102 is threaded into a threaded tap in the riser 100. The counterbores 22 of the two bow mount members 10 are placed over the threaded stud 102. The coupler 25 includes a through thread 27. The coupler 25 is threaded on to the threaded stud 102 and tightened against the two bow mount members 10. An outer perimeter of the bow pivoting extension 18 of a first bow mount member 10 is sized to be received by the counterbore 22 of a second bow mount member 10. The elbow link 12 is secured to the bow mount base 16 with a fastener 29. The fastener 29 is preferably a hollow titanium fastener. The fastener 29 includes a retention head 33 and a bore 35, which extends through at least substantially all of a length thereof. The hollow titanium fastener focuses mass and reduces the space/weight ratio, and thus reduces vibration transfer between two members it joins. It is preferable that the fastener 29 is hollow and fabricated from titanium.

Figure 4:
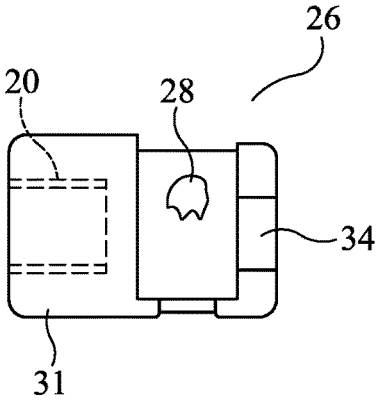
FIG. 4 is a side view of a bow mount member with quick release of an adjustable stabilizer system in accordance with the present invention.
Figure 5:
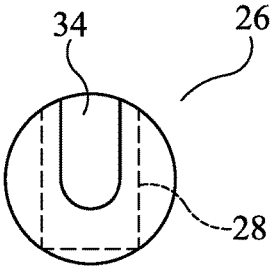
FIG. 5 is an end view of a bow mount member with quick release of an adjustable stabilizer system in accordance with the present invention.
Figure 6:
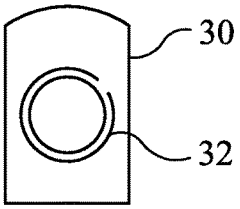
FIG. 6 is a front view of a quick release pin for a bow mount member with quick release of an adjustable stabilizer system in accordance with the present invention.

With reference to FIGS. 4-6, a bow mount member with quick release 26 includes a bow mount base 31 and a quick release cavity 28. The quick release cavity 28 is formed in one end of the bow mount base 31 and the threaded tap 20 is formed in an opposing end thereof. The quick release cavity 28 is sized to receive a rectangular quick release pin 30. The release pin 30 includes a threaded retention tap 32 formed therethrough. The threaded retention tap 32 is sized to threadably receive a threaded rod 106 on one end of a stabilizer 104. A U-shaped slot 34 is formed through the one end of the bow mount base 31 and through the quick release cavity 28.

Figure 7:
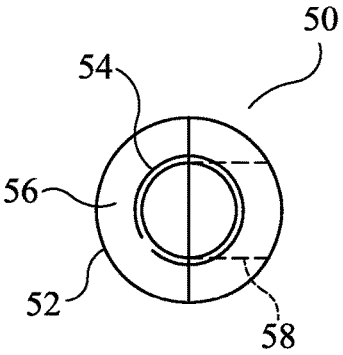
FIG. 7 is a top view of a tightening elbow for a bow mount member with quick release of an adjustable stabilizer system in accordance with the present invention.
Figure 8:
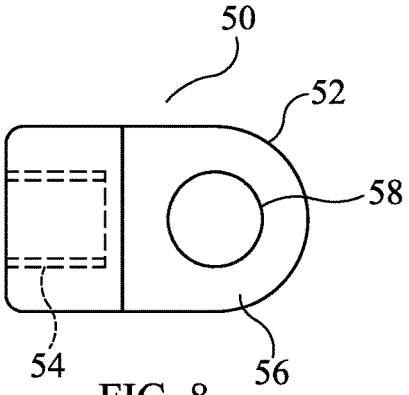
FIG. 8 is a side view of a tightening elbow of an adjustable stabilizer system in accordance with the present invention.
Figure 14:
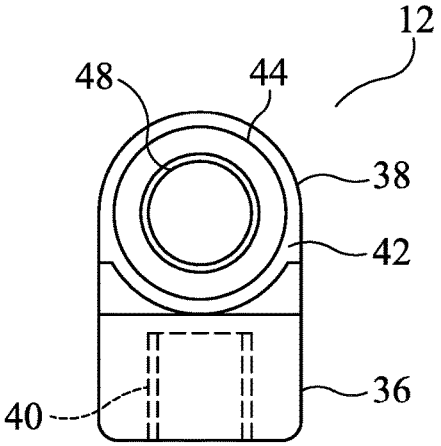
FIG. 14 is a side view of an elbow link member of an adjustable stabilizer system in accordance with the present invention.
Figure 15:
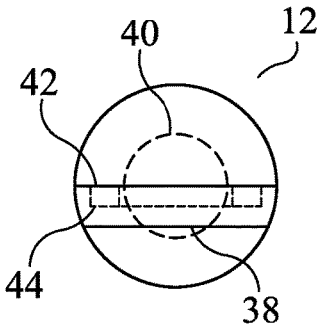
FIG. 15 is a top view of an elbow link member of an adjustable stabilizer system in accordance with the present invention.

With reference to FIGS. 14-15, the elbow link member 12 preferably includes an elbow mounting base 36 and an elbow pivoting extension 38. The elbow pivoting extension 38 extends outward from one end of the elbow mounting base 36 and a threaded tap 40 is formed in an opposing end of the elbow mounting base 36. A first surface 42 of the elbow pivoting extension 38 is flush with a centerline of the threaded tap 40. An o-ring groove 44 is preferably formed in the first surface to receive an o-ring 46. A fastener clearance hole 48 is formed through the elbow pivoting extension 38. With reference to FIGS. 7-8, a tightening elbow 50 includes an elbow body 52. The threaded tap 54 is formed in one end of the elbow body 52. A pivot slot 56 is formed in an opposing end of the elbow body and perpendicular to the one end of the elbow body 52. A bottom of the pivot slot is flush with a centerline of the threaded tap 54. A pivot hole 58 is formed through the pivot slot 56.

Figure 10:
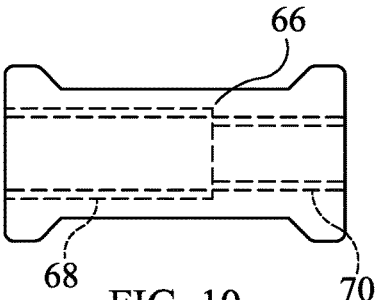
FIG. 10 is a side view of a coupler with two tap sizes of an adjustable stabilizer system in accordance with the present invention.
Figure 11:
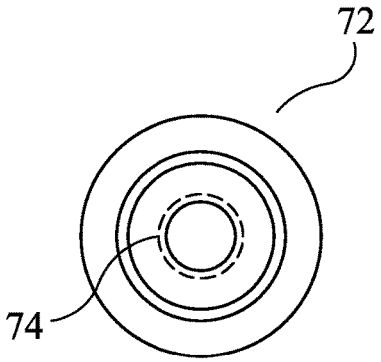
FIG. 11 is a front view of a stabilizer weight with an o-ring of an adjustable stabilizer system in accordance with the present invention.
Figure 12:
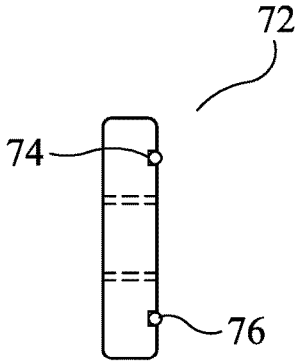
FIG. 12 is a side view of a stabilizer weight with an o-ring of an adjustable stabilizer system in accordance with the present invention.

With reference to FIGS. 1-2, the elbow link member with quick release 14 includes an elbow mounting base 60, a quick release cavity 62 and a pivot extension 64. The pivot extension 64 extends from the elbow mounting base 60. The quick release cavity 62 is formed in the elbow mounting base 60. A pivot hole 66 is formed through the pivot extension 64. A U-shaped slot 68 is formed through an end of the elbow mounting base 60 and through the quick release cavity 62. With reference to FIG. 10, a double thread coupler 66 includes a first threaded tap 68 in a first end and a second threaded tap 70 formed in a second end thereof. With reference to FIGS. 11-12, a stabilizer weight 72 includes a round perimeter and an o-ring groove 74. The o-ring groove 74 is sized to receive an o-ring 76. The stabilizer weight 72 is retained on the threaded rod 108 on an opposing end of the stabilizer 104 with a threaded nut or the like. The o-ring 76 is used to prevent the stabilizer weight 72 from knocking and/or shaking loose.

It is preferable that the fastener 29 is hollow and fabricated from titanium. The fastener 29 includes a retention head 33. The bow mount member 10, the elbow link member 12, the elbow link member with quick release 14, the coupler 25, the bow mount member with quick release 26, the quick release pin 30 and the tightening elbow 50 are preferably fabricated from a T-6061 aluminum, but other materials may also be used. With reference to FIG. 1, it is preferable that a thin washer 78 be inserted between the bow mount member 10 and the elbow link member 12, the elbow link member with quick release 14 or the tightening elbow 50. The thin washer 78 is preferably fabricated from GR 2 titanium, but other materials may also be used.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable stabilizer system for attachment to a front of a riser of an archery bow, comprising:

a first stabilizer member being capable of pivotal engagement with the front of the riser of an archery bow, said first stabilizer member includes a first lengthwise axis, said first lengthwise axis is perpendicular to a first axis of said pivotal engagement;

an o-ring;

a second stabilizer member is pivotally secured in a second axis to said first stabilizer member, said first axis is perpendicular to said second axis, an o-ring groove being formed in one of said first stabilizer member and said second stabilizer member, said o-ring groove is sized to retain said o-ring, said o-ring is in contact with said first and second stabilizer members, said first lengthwise axis is perpendicular to a second lengthwise axis of said second stabilizer member; and said first stabilizer member includes a first bow mounting base and a first bow pivoting extension, said first bow pivoting extension extends from one end of said first bow mounting base, a first counterbore is formed on one side of said first bow pivoting extension perpendicular to an opposing end of said first bow mounting base, a first threaded tap is formed in an opposing end of said first bow mounting base, a bottom of said first counterbore is substantially flush with a centerline of said first threaded tap.

2. The adjustable stabilizer system of claim 1 wherein:

said second stabilizer member includes a second bow mounting base and a second bow pivoting extension, said second bow pivoting extension extends from said second bow mounting base, said second bow pivoting extension is pivotally engaged with said first bow mounting base.

3. An adjustable stabilizer system for attachment to a front of a riser of an archery bow, comprising:

a first stabilizer member being capable of pivotal engagement with the front of the riser of an archery bow on a first axis, said first axis is perpendicular to a first axis of said pivotal engagement;

a fastener;

a second stabilizer member is pivotally secured to said first stabilizer member with said fastener on a second axis, said first axis is perpendicular to said second axis; and said first stabilizer member includes a first bow mounting base and a first bow pivoting extension, said first bow pivoting extension extends from one end of said first bow mounting base, a first counterbore is formed on one side of said first bow pivoting extension perpendicular to an opposing end of said first bow mounting base, a first threaded tap is formed in an opposing end of said first bow mounting base, a bottom of said first counterbore is substantially flush with a centerline of said first threaded tap.

4. The adjustable stabilizer system of claim 3 wherein:

said second stabilizer member includes a second bow mounting base and a second bow pivoting extension, said second bow pivoting extension extends from said second bow mounting base, said second bow pivoting extension is pivotally engaged with said first bow mounting base.

5. An adjustable stabilizer system of claim 3 wherein:

said fastener having a bore which extends through at least substantially all of a length thereof.

6. An adjustable stabilizer system for attachment to a front of a riser of an archery bow, comprising:

a first stabilizer member being capable of pivotal engagement with the front of the riser of an archery bow on a first axis, said first axis is perpendicular to a first axis of said pivotal engagement;

a fastener;

a second stabilizer member is pivotally secured to said first stabilizer member with said fastener on a second axis, said first axis is perpendicular to said second axis; and said second stabilizer member includes a second bow mounting base and a second bow pivoting extension, said second bow pivoting extension extends from one end of said second bow mounting base, a second counterbore is formed on one side of said second bow pivoting extension perpendicular to an opposing end of said second bow mounting base, a second threaded tap is formed in an opposing end of said second bow mounting base, a bottom of said second counterbore is substantially flush with a centerline of said second threaded tap.

7. The adjustable stabilizer system of claim 6 wherein:

said first stabilizer member includes a second bow mounting base and a first bow pivoting extension, said first bow pivoting extension extends from said first bow mounting base, said first bow pivoting extension is pivotally engaged with said first bow mounting base.

8. An adjustable stabilizer system for attachment to a front of a riser of an archery bow, comprising:

a first stabilizer member being capable of pivotal engagement with the front of the riser of an archery bow, said first stabilizer member includes a first lengthwise axis, said first lengthwise axis is perpendicular to a first axis of said pivotal engagement;

an o-ring;

a second stabilizer member is pivotally secured in a second axis to said first stabilizer member, said first axis is perpendicular to said second axis, an o-ring groove being formed in one of said first stabilizer member and said second stabilizer member, said o-ring groove is sized to retain said o-ring, said o-ring is in contact with said first and second stabilizer members, said first lengthwise axis is perpendicular to a second lengthwise axis of said second stabilizer member; and said second stabilizer member includes a second bow mounting base and a second bow pivoting extension, said second bow pivoting extension extends from one end of said second bow mounting base, a second counterbore is formed on one side of said second bow pivoting extension perpendicular to an opposing end of said second bow mounting base, a second threaded tap is formed in an opposing end of said second bow mounting base, a bottom of said second counterbore is substantially flush with a centerline of said second threaded tap.

9. The adjustable stabilizer system of claim 8 wherein:

said first stabilizer member includes a second bow mounting base and a first bow pivoting extension, said first bow pivoting extension extends from said first bow mounting base, said first bow pivoting extension is pivotally engaged with said first bow mounting base.

* * * * *